US005775885A

United States Patent [19]

Dreiman et al.

[11] Patent Number: 5,775,885

[45] Date of Patent: Jul. 7, 1998

[54] COMBINATION SUCTION MANIFOLD AND CYLINDER BLOCK FOR A RECIPROCATING COMPRESSOR

[75] Inventors: Nelik I. Dreiman, Tipton; Russell A. Cowen, Brooklyn, both of Mich.

[73] Assignee: Tecumseh Products Company, Tecumseh, Mich.

[21] Appl. No.: 603,647

[22] Filed: Feb. 20, 1996

[51] Int. Cl.[6] ..... F04B 39/10

[52] U.S. Cl. ..... 417/553; 417/490; 417/312; 417/566; 92/144

[58] Field of Search ..... 417/553, 490, 417/501, 540, 312; 92/144, 181 R

[56] References Cited

U.S. PATENT DOCUMENTS

| | | | |
|---|---|---|---|
| 1,107,284 | 8/1914 | Gardner . | |
| 1,454,347 | 5/1923 | Stoms . | |
| 1,493,935 | 5/1924 | Hack | 417/490 |
| 1,611,789 | 12/1926 | Spreen . | |
| 1,688,890 | 10/1928 | Spreen . | |
| 1,688,903 | 10/1928 | Thompson | 417/490 |
| 1,689,794 | 10/1928 | Morris . | |
| 1,764,655 | 6/1930 | Spreen . | |
| 2,193,243 | 3/1940 | Teeter . | |
| 2,302,448 | 11/1942 | Leonard . | |
| 3,401,873 | 9/1968 | Privon . | |
| 3,542,493 | 11/1970 | Alderson . | |
| 3,785,453 | 1/1974 | Buonocore . | |
| 4,033,707 | 7/1977 | Stutzman . | |
| 4,239,461 | 12/1980 | Elson . | |
| 4,401,418 | 8/1983 | Fritchman | 417/540 |
| 4,411,600 | 10/1983 | Itagaki . | |
| 4,719,846 | 1/1988 | Langstroth | 92/181 R |
| 4,795,316 | 1/1989 | Kropiwnicki . | |
| 4,834,632 | 5/1989 | Gatecliff | 417/553 |
| 4,842,492 | 6/1989 | Gannaway | 417/540 |
| 4,850,816 | 7/1989 | Kosfeld . | |
| 4,955,796 | 9/1990 | Terwilliger . | |
| 4,995,791 | 2/1991 | Loprete . | |
| 5,080,130 | 1/1992 | Terwilliger . | |
| 5,106,278 | 4/1992 | Terwilliger . | |
| 5,129,793 | 7/1992 | Blass . | |
| 5,174,735 | 12/1992 | Gannaway | 417/553 |
| 5,203,857 | 4/1993 | Terwilliger . | |
| 5,232,354 | 8/1993 | Clement . | |
| 5,266,015 | 11/1993 | Gannaway . | |
| 5,326,231 | 7/1994 | Pandeya . | |
| 5,346,373 | 9/1994 | Riffe . | |
| 5,476,371 | 12/1995 | Dreiman | 417/553 |

FOREIGN PATENT DOCUMENTS

| | | | |
|---|---|---|---|
| 761622 | of 0000 | France | 417/490 |

*Primary Examiner*—Timothy Thorpe
*Assistant Examiner*—Cheryl J. Tyler
*Attorney, Agent, or Firm*—Baker & Daniels

[57] ABSTRACT

A hermetically sealed reciprocating refrigeration compressor has a suction gas arrangement including a suction gas plenum formed integral with a cylinder block for supplying suction gas directly to a cylinder so as to eliminate the need for external suction gas conduits. Apertures are formed about the circumference of the cylinder for receiving suction gas directly from the suction gas plenum. Pistons are provided with multiple suction gas entrances and a semi-toroidal suction valve to provide an efficient way of introducing suction gas into a compression chamber during a suction stroke of the compressor. A spherical discharge valve assembly is provided in a valve plate adjacent the compression chamber for improved flow characteristics and increased through flow area.

40 Claims, 5 Drawing Sheets

COMBINATION SUCTION MANIFOLD AND CYLINDER BLOCK FOR A RECIPROCATING COMPRESSOR

BACKGROUND OF THE INVENTION

The invention relates generally to fluid pumps or compressors for compressing fluids such as refrigerant gases. More particularly, the invention relates to suction intake manifold/plenum arrangements for introducing suction gas into the cylinder portion of reciprocating compressors. The present invention relates specifically to compressors in which the motor and compressor are enclosed in a hermetically sealed casing or housing.

Prior compressors of this type involve suction gas intakes, passage tubes, plenums, and manifolds which are external to and separate from the cylinder block of the compressor. Such a compressor is illustrated in U.S. Pat. No. 4,721,443 (Allen), which is hereby incorporated into this document by reference and which is assigned to the assignee of the present invention. Other such arrangements are disclosed in U.S. Pat. No. 5,080,130 (Terwilliger) and U.S. Pat. No. 5,326,231 (Pandeya et al). Such prior suction manifolds consist of numerous interconnected parts making assembly and maintenance complex and expensive, especially when separate suction manifolds are required to supply suction gas to both sides of the cylinders.

Because of economic and operational concerns, the size, weight, and complexity of such compressors are preferably minimized while providing superior capacity and efficiency of operation. Overall, system dynamics must be considered when designing such systems. Such dynamics include operating temperature, inertial forces within the compressor, system durability, noise, etc. One concern associated with all such compressors is the desire to minimize any heat gain realized by the suction gas after entering the compressor housing and while passing along the suction gas passageway before entering the compression chamber of the cylinder.

In the prior art compressors, the suction gas passageway is separate from the cylinder block and in many cases multiple passageways and pulsation/noise attenuators are required. The length of external suction passage tubing is a source of extensive vibrations and high and low frequency noise. External tubing requires special means, such as attenuating chambers, increased stiffness, special plastic materials, etc., to reduce gas pulsations, eliminate resonance, and minimize heat transfer to the suction gas from the environment within the compressor shell.

A problem commonly associated with refrigerant compressors is that the suction gas, as it passes through the hermetically sealed compressor housing to the cylinder, absorbs heat generated during compressor operation. This results in a reduction in suction gas density before it is introduced into the compression chamber, which causes a decrease in operating efficiency.

A combination suction plenum and cylinder block is needed which minimizes heat transfer to the suction gas, simplifies construction, and improves efficiency. A need exists to provide a suction gas arrangement of superior thermodynamic characteristics whereby suction gas is communicated from a suction gas inlet to the compression chamber with minimal heat gain. A further need is for a suction gas arrangement comprising few parts and interconnections for a reduction in costs associated with manufacturing, inventory, and maintenance.

SUMMARY OF THE INVENTION

The present invention provides a combination suction gas plenum and cylinder block which eliminates the need for external suction gas conduits. The improved suction gas arrangement minimizes the distance travelled by the suction gas while in the compressor, minimizes suction gas heat gain, and improves compressor operating efficiency. The suction gas plenum integrally formed in the cylinder block surrounds the cylinders and allows suction gas to be drawn into the cylinders through apertures formed about the circumference of the cylinder walls during a suction stroke. Accordingly, the present invention eliminates the need for external suction gas conduits to supply suction gas to multiple apertures about the cylinders.

A coupling provided in the housing of the compressor couples the compressor to a source of suction gas and communicates suction gas into the compressor for delivery to the cylinders for compression. In one form, the coupling is connected directly to the inlet of the suction gas plenum, so as to eliminate the need for conduits external to the block to deliver suction gas to the cylinders. Intermediate the coupling and the suction gas inlet to the block may be a suction muffler. Suction gas is drawn into the suction gas plenum formed in the block and enters the cylinder through apertures positioned about the circumference of the cylinder. Openings provided in the cylindrical walls of the reciprocating pistons receive suction gas from the apertures formed in the walls of the cylinders.

A suction valve is provided in each piston head for communicating suction gas into the compression chamber during the suction stroke. Suction gas is thereby communicated into the cylinder and compression chamber without the need for conduits external to the cylinder block. Further, semi-toroidal suction valves and spherical-shaped discharge valves may be used to improve the flow pattern of the suction gas and discharge gas respectively and increase through flow area.

To enhance compressor operating efficiency, it is important to minimize heat gain associated with the communication of suction gas from the housing inlet to the compression chamber of the cylinder. Accordingly, it is a specific objective of this invention to minimize the length of travel which the suction gas must undergo during compressor operation. The design of the present invention involves minimizing the spacial displacement between the inlet and the suction muffler and between the suction muffler and the cylinder head or block. To reduce the number of parts and the costs associated with manufacturing and to help minimize suction gas heat gain, suction gas tubing external to and separate from the cylinder head are eliminated.

Accordingly, one advantage associated with the present combination suction gas plenum and cylinder block is the realization of improved thermodynamic characteristics. By eliminating the need for external suction gas conduits and introducing gas into the cylinder in a more efficient manner, suction gas experiences minimal heat gain and compressor efficiency is enhanced.

Another advantage associated with the present invention is a reduction in the number of parts required and associated interconnections which results in a reduction in costs associated with manufacturing, inventory, and maintenance.

Yet another advantage associated with the present invention is an improved means of introducing suction gas into the cylinders and reducing the noise and vibrations generated during compressor operation.

In one embodiment, the present invention provides a reciprocating hermetic refrigerant compressor having a cylinder block, head, and piston. The cylinder block includes an inner wall and an outer wall which has a suction gas inlet.

The inner wall is at least partially separated from the outer wall and the outer wall surrounds the inner wall. A cylinder is formed in the inner wall of the block and has a suction gas aperture formed therein.

The cylinder head is attached to the cylinder block and the piston is reciprocatingly received in the cylinder and is drivingly connected to a crankshaft. A suction gas plenum is formed in the space between the inner wall and the outer wall and at least substantially surrounds the cylinder. The suction gas inlet and the suction gas aperture are in fluid communication with the suction gas plenum. Suction gas is drawn directly into the cylinder through the suction gas apertures from the suction gas plenum during a suction stroke of the compressor.

In another embodiment, the invention provides a hermetically sealed reciprocating refrigeration compressor which includes a suction gas muffler, a cylinder block and head, a valve plate, a piston, a discharge valve, and a suction valve. The cylinder block includes an inner wall and an outer wall. The outer wall substantially surrounds the inner wall and is at least partially separated from the inner wall. A suction gas plenum is formed in the space between the inner wall and the outer wall. The suction gas muffler receives suction gas and is in communication with the suction gas plenum. A cylinder is formed in the inner wall and has at least one suction gas aperture formed therein. The piston is reciprocatingly received in the cylinder and has at least one suction gas entrance and a suction gas passage. The cylinder head is connected to the cylinder block and has a suction gas inlet in fluid communication with the suction gas muffler and the suction gas plenum.

The valve plate is interposed between the cylinder head and block and has a discharge port. The discharge valve is interposed between the valve plate and the cylinder head and comprises a discharge valve seat and a discharge valve member. The cylinder, piston, and discharge valve define a compression chamber. The suction valve provided on the piston comprises a suction valve member and a suction valve seat. During a suction stroke, the suction valve member unseats from the suction valve seat and permits suction gas to flow from the suction gas muffler, through the cylinder head, through the suction gas plenum, through the suction gas entrance and into the compression chamber.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
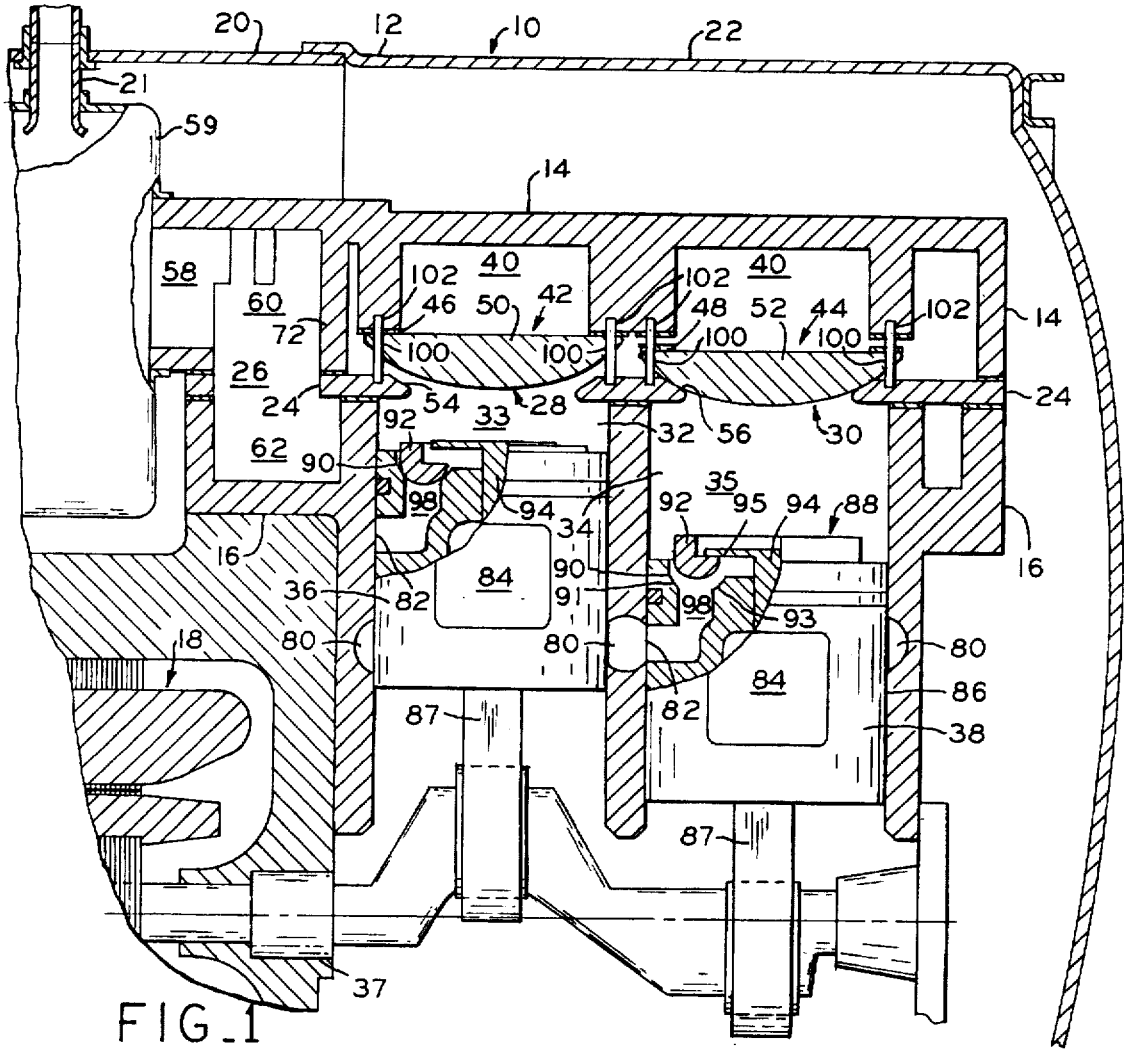
FIG. 1 is a partial cross-sectional side view of a multi-cylinder reciprocating refrigeration compressor including the suction gas arrangement of the present invention.
Figure 3:
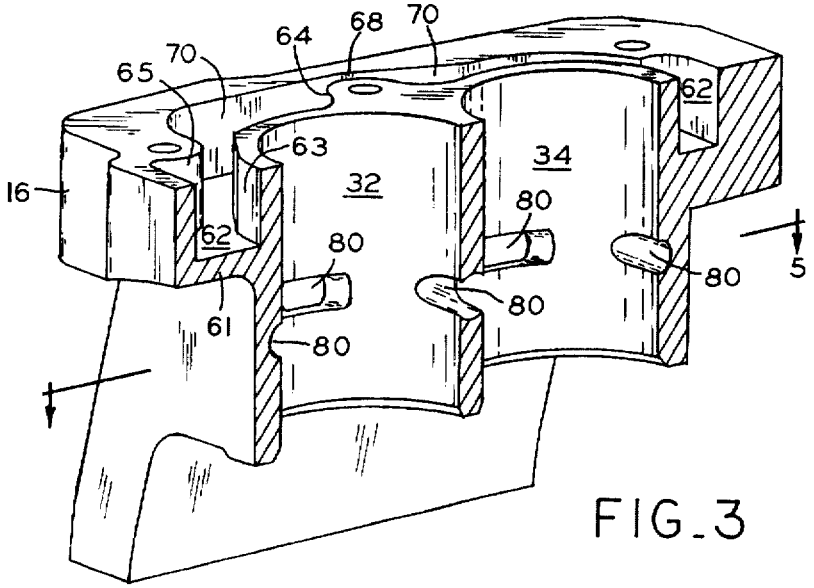
FIG. 3 is a sectional perspective view of the cylinder block of FIG. 2.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DETAILED DESCRIPTION OF THE INVENTION

Referring now to the drawings and particularly to FIG. 1, reciprocating hermetic compressor 10 includes housing 12, cylinder head 14, cylinder block 16, and motor 18. Housing 12 includes upper housing shell 20 and lower housing shell 22 which are circumferentially welded or otherwise joined so as to provide a hermetically sealed compressor unit. Cylinder block 16 is conventionally constructed of die-cast metal, such as aluminum, and has two cylinders 32 and 34. Reciprocating pistons 36 and 38 are received in cylinders 32 and 34 and are rotatably driven by crankshaft 37.

Valve plate 24 is mounted between block 16 and head 14 and includes discharge valve ports 28 and 30. Discharge ports 28 and 30 respectively communicate between cylinders 32 and 34 and discharge cavities 40 formed in cylinder head 14. Discharge valves 42 and 44 are mounted between valve plate 24 and cylinder head 14 and are in communication with cylinders 32 and 34. During compressor operation, suction gas is drawn into cylinders 32 and 34 and is compressed by the operation of pistons 36 and 38. The compressed refrigerant gas is discharged from compression chambers 33 and 35, formed in cylinders 32 and 34, through discharge valves 42 and 44 respectively. Compressor 10 is of the general type described in U.S. Pat. No. 4,721,443 (Allen) which is incorporated herein by reference.

In accordance with the present invention, cylinder block 16 includes inner wall 63 and outer wall 65, which are at least partially spacially separated. Inner wall 63 defines cylinders 32 and 34 and the space between inner wall 63 and outer wall 65 constitutes suction gas plenum 62. Suction gas plenum 62 at least substantially surrounds cylinders 32 and 34, as illustrated in FIGS. 2, 3, 4, and 5, and is in communication with cylinders 32 and 34 via cylinder wall apertures 80. This is described in more detail below.

Figure 2:
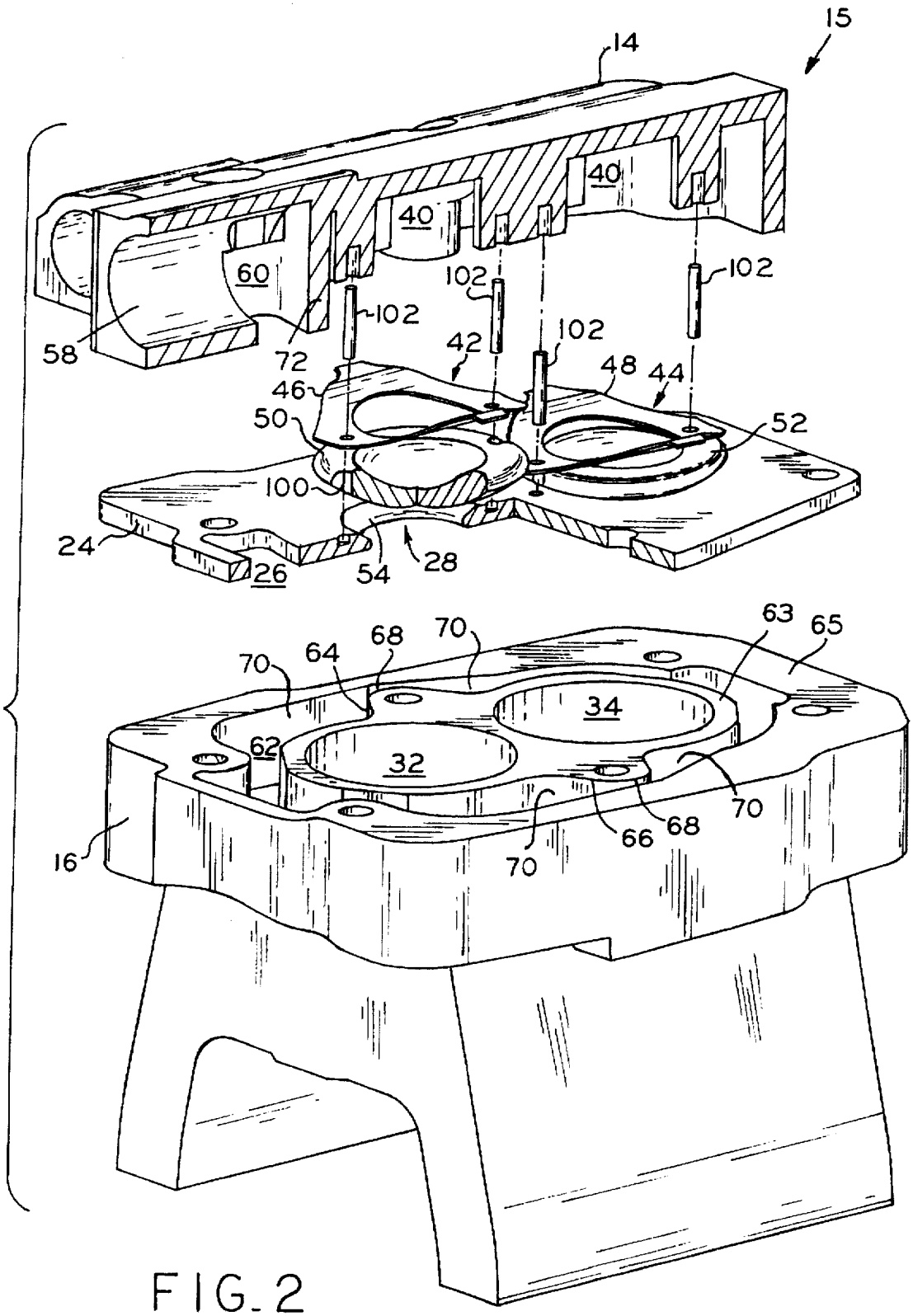
FIG. 2 is an exploded perspective and partial sectional view of the cylinder block, valve plate, and valve head associated with the suction gas arrangement of FIG. 1.

Referring to FIGS. 1 and 2, the flow of suction gas through compressor section 15 of compressor 10 is described as follows. Suction gas enters compressor 10 through inlet or coupling 21 provided on and through housing 12 and is conventionally received into suction muffler 59. To minimize the distance traveled while in compressor 10, suction gas exits suction muffler 59 and directly enters cylinder head 14 at suction gas aperture 58. In accordance with the present invention, no external suction gas tubing is required to supply suction gas to cylinders 32 and 34. Suction gas travels through suction gas chamber 60, which is separated from discharge cavities 40 by cylinder head wall 72. Suction gas is drawn from suction gas chamber 60, through suction gas opening 26, which is formed in valve plate 24, and into suction gas plenum 62.

Figure 8:
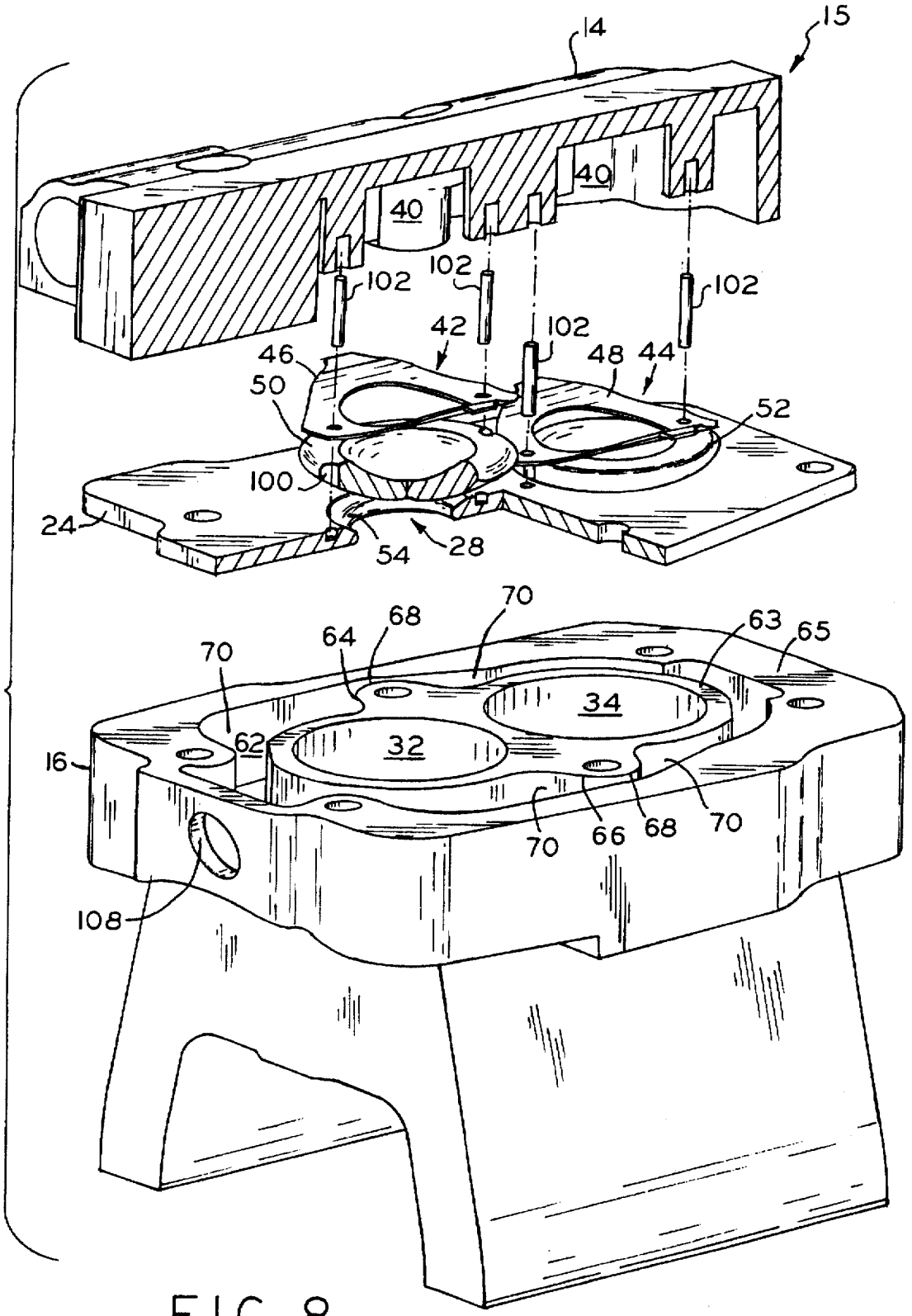
FIG. 8 is a partial cross-sectional perspective view of an alternative arrangement of the combination suction plenum and cylinder block of the present invention.

FIG. 8 illustrates an alternative suction gas arrangement according to the present invention. Suction gas enters and exits the suction muffler as described above. To further minimize the distance traveled while in compressor 10, suction gas exits suction muffler 59 and enters suction plenum 62 directly via outer wall aperture 108 formed in block 16. Unlike the arrangement of FIG. 2, suction gas is not required to flow through cylinder head 14 or valve plate 24. This serves to further reduce the distance travelled by the suction gas prior to compression and the heat gain associated with such exposure. The remainder of the operation is as described above and below.

Figure 4:
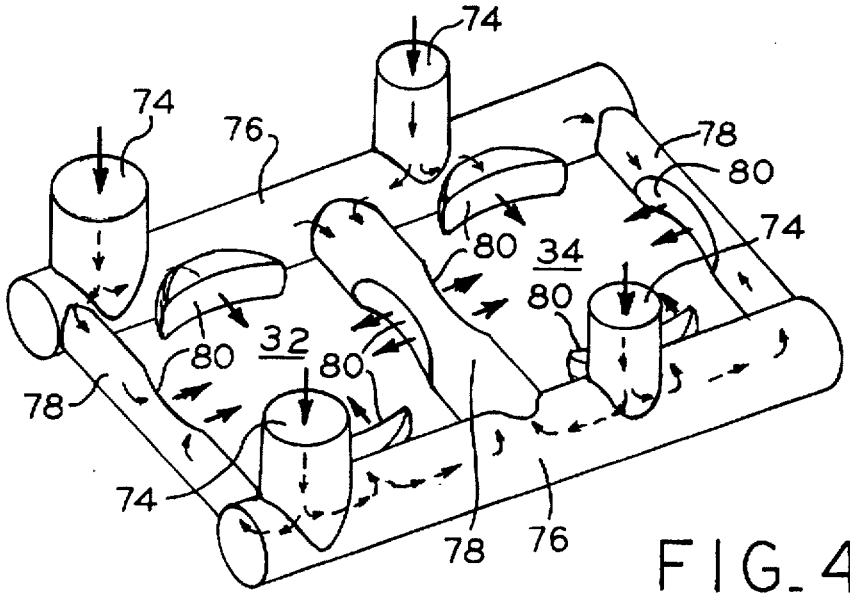
FIG. 4 is a flow diagram representing the suction gas flow channels associated with the suction gas plenum formed in the cylinder block of FIG. 2.
Figure 5:
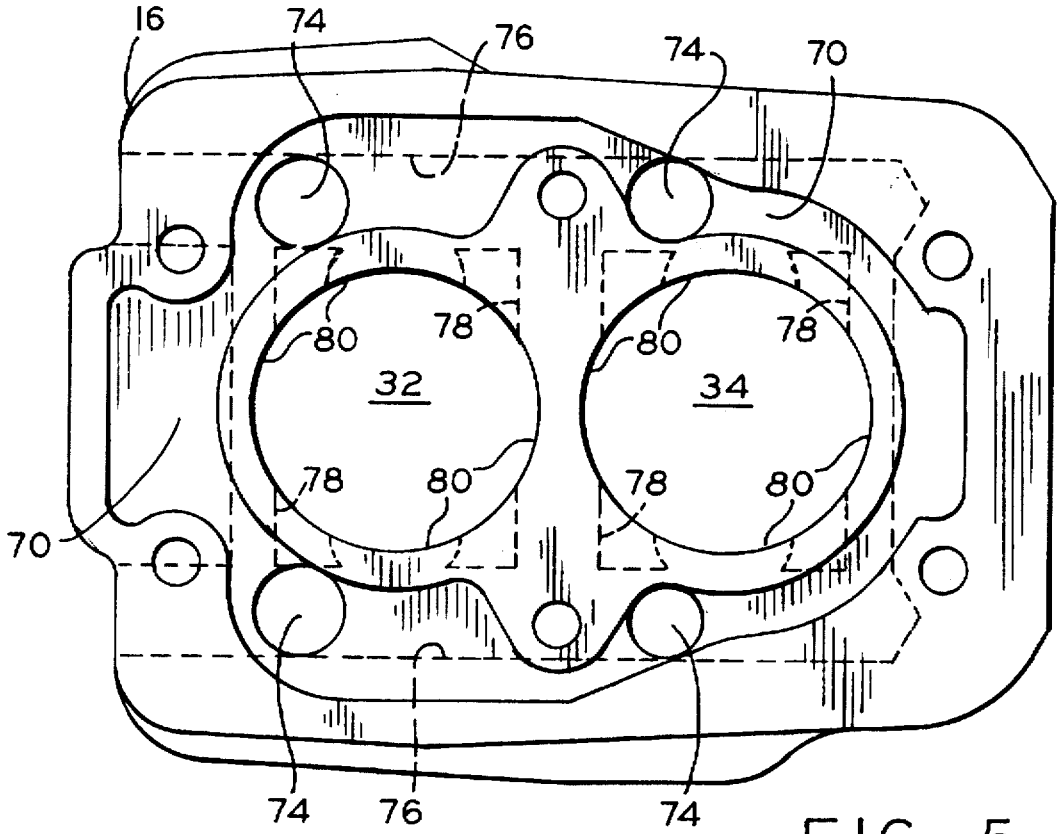
FIG. 5 is a plan view of the cylinder block of FIG. 2.
Figure 6:
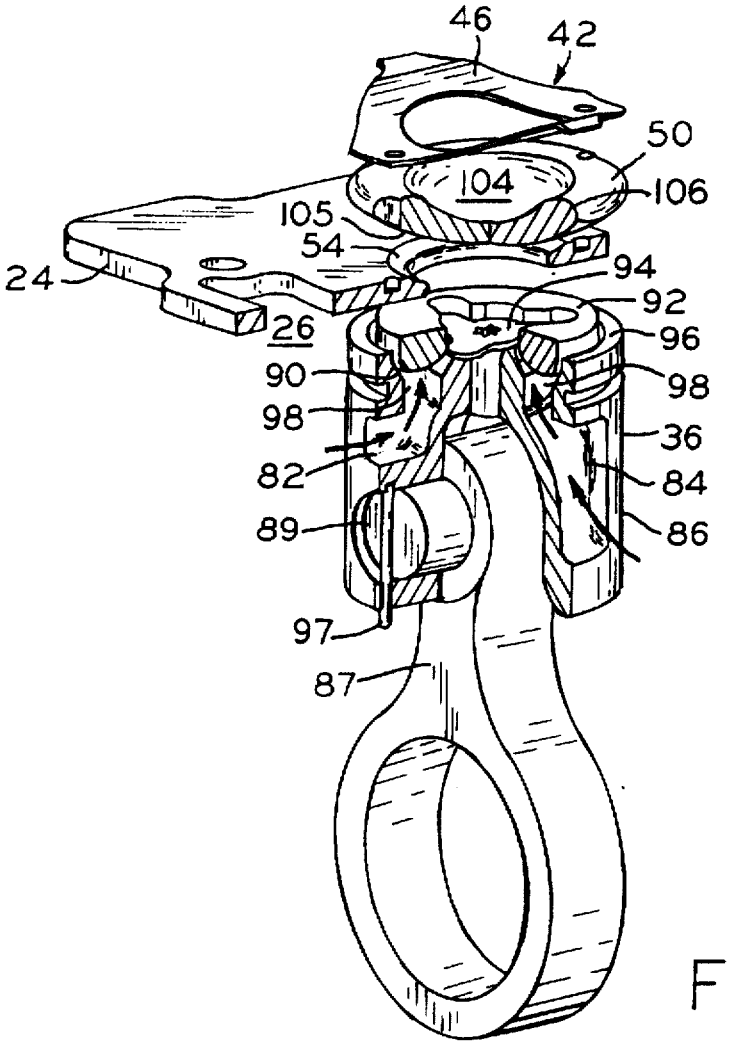
FIG. 6 is an exploded partially cut away perspective view of the piston, valve plate, and discharge valve of the reciprocating compressor of FIG. 1.
Figure 7:
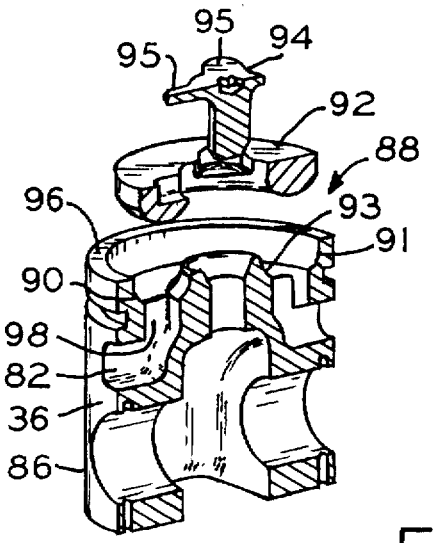
FIG. 7 is an exploded sectional perspective view of the piston head and suction valve assembly associated with the piston of FIG. 6.

Referring now to FIGS. 1–5, cylinder block 16 includes floor 61 which separates suction gas plenum 62 from suction gas channels 76 and 78, which are in direct fluid communication with cylinders 32 and 34. Orifices 74 are formed in floor 61 and are in communication with suction gas plenum 62 and suction gas channels 76 and 78. As best illustrated in FIG. 4, during a suction stroke, suction gas is drawn into orifices 74 from suction gas plenum 62 and flows along suction gas channels 76 and 78. Suction gas is ultimately drawn into cylinders 32 and 34 via cylinder wall apertures 80 which are located about the circumference of cylinders 32 and 34.

By forming a suction plenum within the cylinder block which at least substantially surrounds the cylinders, the present invention achieves enhanced communication of suction gas into the cylinder. Multiple cylinder wall apertures 80 are spaced circumferentially about cylinders 32 and 34 and allow suction gas to enter the cylinder simultaneously from multiple locations. This improved method of introducing suction gas into the cylinders provides increased flow of suction gas into the cylinder and helps eliminate noise and vibrations. Without such a suction gas plenum in the cylinder block, separate external suction gas tubing would be required to supply suction gas to the cylinder from multiple locations. The use of external tubing would result in a lengthened route to the cylinder and added suction gas heat gain. To further reduce pulsations and noise associated with compressor operation, walls or baffles 64 and 66 extend radially from inner wall 63 so as to form restricted passages 68 and sub-plenums 70 in suction plenum 62.

In addition, compressor operating efficiency is improved by providing a more effective discharge and suction valve arrangement. FIGS. 1, 2, 6, and 7 illustrate one embodiment of the piston, suction valve, valve plate, and discharge valve for use in the compressor of the present invention. Piston 36 is connected to connecting rod 87 by wrist pin 89 in conjunction with retention pin 97. Piston 36 includes suction gas openings 82 and 84 which are spaced about cylindrical piston wall 86. Suction valve assembly 88 comprises annular suction valve seat 90, annular suction valve member 92, and suction valve retention member 94 and is provided on piston 36. Suction valve seat 90 is annular and semi-toroidal in shape and is formed on upper surface 96 of piston 36. Annular suction gas passage 98, formed in piston 36, is in communication with valve seat 90 and suction gas openings 82 and 84. The use of semi-toroidal suction valve assembly 88 makes it possible for suction gas to enter the compression chamber along both the outside and the inside circumference of valve member 92.

As illustrated, the curved surface of suction valve member 92 has an arcuate cross section which faces and matches the shape of the curved annular suction valve seat 90, which also has an arcuate cross section. By forming the suction gas passages in this manner, in combination with radiusing of the suction valve port and valve member entrance and exit edges, the pressure drop across suction valve assembly 88 will be minimized. This design directs the flow of the incoming suction gas more smoothly and without sharp turns, helps eliminate noise generated by valve flutter, and improves efficiency of the compressor.

Annular semi-toroidal valve member 92 is preferably made of polymeric material and seats against matching semi-toroidal valve seat 90. Semi-toroidal valve seat 90 is split into annular inner valve seat 91 and annular outer valve seat 93, which are separated by annular suction gas passage 98. With suction valve member 92 in an unseated position during periods of valve opening, an inner flow passage and an outer flow passage are created. Suction gas flows into compression chambers 33 and 35 through the inner and outer passages around suction valve member 92 during the suction stroke. This increases the effective valve flow area and minimizes the pressure drop across suction valve 88.

Suction valve retention member 94 is preferably a clamping bolt having a specially shaped head including a plurality of radially extending fingers 95. Retention member 94 connects suction valve member 92 to piston 36. Extending fingers 95 engage the suction valve member during the suction stroke so as to allow limited axial movement of suction valve member 92 away from suction valve seat 90. In this manner, the impact forces generated during collision of valve member 92 with retaining member 94 are more evenly distributed along a larger flat open surface of the suction valve member as apposed to only the central portion as characterized by the prior art. This increases valve life and reduces maintenance.

As with discharge valve members 50 and 52, the curved surface of suction valve member 92 is almost immediately completely exposed to the suction fluid pressure upon suction valve opening. By maximizing the area exposed to the suction pressure, valve acceleration is increased at valve opening, thereby increasing compressor performance. Such an improved suction valve is disclosed in U.S. Pat. No. 5,476,371 (Dreiman) assigned to the assignee of the present invention, which is incorporated herein by reference.

In the embodiment shown, discharge valve assemblies 42 and 44 are spherical shaped resulting in enhanced flow dynamics. Discharge valve assemblies 42 and 44 are respectively adjacent pistons 36 and 38 and cylinders 32 and 34 and comprise discharge valve springs 46 and 48, semi-spherical discharge valve members 50 and 52, and semi-spherical discharge valve seats 54 and 56. Discharge valve seats 54 and 56 are formed in valve plate 24 at discharge ports 28 and 30 respectively and are in communication with cylinders 32 and 34 and discharge cavities 40 in cylinder head 14.

Curved surfaces 105 and 103 of semi-spherical discharge valve member 50 and discharge valve seat 54 provide an increased flow area, a minimum pressure drop, and a minimum cylinder re-expansion volume during compressor operation. Discharge valve member 50 is preferably made of a polymeric material having high damping characteristics. An advantage associated with this configuration is that upon discharge valve opening, discharge valve member 50 has substantially all of seating surface 105 immediately exposed to fluid pressure generated within compression chamber 33. This maximum exposure of compressed fluid to the increased surface area of discharge valve member 50 during valve opening accelerates discharge valve opening thereby increasing compressor performance while decreasing possible throttling effects.

The shape of discharge valve seat 54 along with the radiusing of the valve plate port edges, eliminates sharp turns, minimizes the pressure drop across the discharge valve, and allows the smooth flow of gas therethrough. In addition to improved compressor operating efficiency, valve fluttering and intermittent chattering noises are eliminated. Further, the radiusing permits greater tolerance in the event of any shifting, cocking or tilting of valves 42 or 44 at closing. Due to the mating spherical surfaces, valve member 50 will tolerate misalignment and effectively seat and seal against valve seat 54.

Polymeric solid valve member 50 effectively eliminates bending and flexural stress so as to greatly reduce failure. The high damping characteristics associated with the polymeric material reduces valve noise during compressor operation. A valve material with high damping characteristics, such as a polymeric plastic, will absorb induced stress peaks more efficiently, minimize valve damage, and reduce noise generated by impact during compressor operation.

As illustrated, discharge valve member 50 includes two diametrically opposed recesses 100 into which are received guide pin members 102. Guide pin members 102 guide the movement of discharge valve member 50 during compressor operation. Arcuate springs 46 and 48 are interposed between valve members 50 and 52 and cylinder head 14 and bias discharge valve members 50 and 52 toward discharge valve seats 54 and 56 respectively. In addition, discharge valve members 50 and 52 may be provided with concave rear surface cavity 104 and rounded annular rear surface 106 which serve to reduce wear of arcuate spring 46 by limiting the line contact at pin 102 locations. The spherically shaped sealing surfaces of valve member 50 and valve seat 54 form a radial diffuser for refrigerant passing through discharge port 28, whereby refrigerant turbulence and discharge valve flutter are reduced.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A reciprocating hermetic refrigerant compressor, comprising:

a housing;

a motor disposed in said housing and having a stator and a rotor connected to a crankshaft;

a cylinder block disposed in said housing and having an inner wall and an outer wall, said inner wall being at least partially separated from said outer wall, said outer wall surrounding said inner wall;

a cylinder formed in said inner wall and having a suction gas aperture extending through said inner wall into said cylinder;

a cylinder head attached to said cylinder block;

a piston reciprocatingly received in said cylinder and drivingly connected to said crankshaft;

a suction gas plenum provided in the space between said inner wall and said outer wall and at least partially surrounding said cylinder, said suction gas aperture being in fluid communication with said suction gas plenum; and a suction gas inlet in fluid communication with said suction gas plenum and said suction gas aperture, whereby suction gas is drawn directly into said cylinder through said suction gas aperture from said suction gas plenum during a suction stroke of said compressor.

2. The compressor as claimed in claim 1 including a plurality of suction gas apertures spaced about the circumference of said cylinder.

3. The compressor as claimed in claim 2 wherein said plurality of suction gas apertures comprises four apertures spaced ninety degrees apart about the circumference of said cylinder.

4. The compressor as claimed in claim 1 and further comprising:

a suction valve having a suction valve seat formed on an upper surface of said piston and a suction valve member attached to said piston adjacent said suction valve seat;

a suction gas entrance formed in said piston;

a suction gas passage formed in said piston and in fluid communication with said suction gas plenum and said suction valve; and a compression chamber formed in said cylinder between said piston and said cylinder head, whereby during the suction stroke of said compressor suction gas flows from said suction gas inlet into said suction gas plenum, through said suction gas aperture into said cylinder, through said suction gas entrance into said suction gas passage, and through said suction gas valve into said compression chamber.

5. The compressor as claimed in claim 4 including a plurality of suction gas entrances spaced about the circumference of said piston.

6. The compressor as claimed in claim 5 wherein said plurality of suction gas entrances comprises four entrances spaced ninety degrees apart about the circumference of said piston.

7. The compressor as claimed in claim 4 wherein said suction valve seat comprises an annular inner valve seat and an annular outer valve seat, said annular inner valve seat is surrounded by and at least partially spatially separated from said annular outer valve seat, whereby during the suction stroke said suction valve member becomes unseated relative said suction valve seat so as to permit suction gas to flow from said suction gas entrance, through said suction gas passage, between said inner and outer valve seats, across said valve member, and into said compression chamber.

8. The compressor as claimed in claim 4, wherein said suction valve member and said suction valve seat are substantially semi-toroidal in shape.

9. The compressor as claimed in claim 4, wherein said suction valve member is made of a polymeric material.

10. The compressor as claimed in claim 1 further comprising:

a valve plate interposed between said cylinder head and said cylinder block;

a discharge valve interposed between said valve plate and said cylinder head and having a discharge valve member and a discharge valve seat, said piston, said cylinder, said discharge valve, and said valve plate defining said compression chamber.

11. The compressor as claimed in claim 10, wherein said discharge valve further comprises a guide pin, said discharge valve member includes a recess adapted to receive said guide pin, and said cylinder head and said valve plate define bores adapted to receive said guide pin.

12. The compressor as claimed in claim 10, wherein said discharge valve further comprises a valve spring interposed between said discharge valve member and said cylinder head, said valve spring defines holes adapted to receive said guide pin, and said valve spring exerts a bias force upon said discharge valve in a valve closing direction.

13. The compressor as claimed in claim 10, wherein said discharge valve member is made of a polymeric material.

14. The compressor as claimed in claim 10, wherein said discharge valve member and said discharge valve seat are substantially semi-spherical in shape.

15. The compressor as claimed in claim 1 wherein at least one of said outer wall and said inner wall have at least one baffle wall extending therefrom into said suction gas plenum to reduce suction gas pulsations and noise.

16. The compressor as claimed in claim 1 wherein at least one of said outer wall and said inner wall have at least one wall extending therefrom into said suction gas plenum so as to form at least two suction gas sub-plenums.

17. The compressor as claimed in claim 1 including at least two cylinders with said suction gas plenum substantially surrounding said at least two cylinders.

18. The compressor as claimed in claim 1 and further comprising a suction gas coupling through which suction gas is received into said compressor, said suction gas coupling being connected directly to said suction gas inlet, whereby suction gas is delivered to said cylinder without the use of external suction gas conduits.

19. The compressor as claimed in claim 1 and further comprising a suction gas coupling through which suction gas is received into said compressor and a suction muffler interposed between said suction gas coupling and said cylinder block, said suction gas muffler in fluid communication with said suction gas inlet, whereby suction gas is delivered to said cylinder without the use of external suction gas conduits.

20. The compressor as claimed in claim 1 wherein said suction gas inlet is provided in said cylinder block, whereby suction gas is communicated directly into said suction gas plenum.

21. The compressor as claimed in claim 1 wherein said suction gas inlet is provided in said cylinder head, whereby suction gas is communicated from said inlet, through said cylinder head and into said suction gas plenum.

22. The compressor as claimed in claim 21 further comprising a valve plate interposed between said cylinder head and said cylinder block, said valve plate having a suction gas opening communicating between said suction gas inlet and said suction gas plenum.

23. A reciprocating hermetic refrigeration compressor comprising:

a housing;

a motor disposed in said housing and having a stator and a rotor connected to a crankshaft;

a suction gas muffler adapted to receive suction gas;

a cylinder block disposed in said housing and having an inner wall and an outer wall at least partially surrounding said inner wall and being at least partially separated from said inner wall;

a cylinder formed in said inner wall and having a suction gas aperture formed therein;

a piston reciprocatingly received in said cylinder and having a suction gas entrance and a suction gas passage, said piston being driven by said crankshaft;

a suction gas plenum formed in the space between said inner wall and said outer wall;

a cylinder head connected to said cylinder block and having a suction gas inlet in fluid communication with said suction gas muffler and said suction gas plenum;

a valve plate interposed between said cylinder head and said cylinder block and having a discharge port;

a discharge valve interposed between said valve plate and said cylinder head and comprising a discharge valve seat and a discharge valve member, said cylinder, said piston, said valve plate, and said discharge valve defining a compression chamber; and a suction valve provided on said piston and comprising a suction valve member and a suction valve seat, during a suction stroke said suction valve member unseating from said suction valve seat so as to permit suction gas to flow from the suction gas muffler, through said cylinder head, through said suction gas plenum, through said suction gas entrance, through said suction gas passage, and into said compression chamber.

24. The compressor of claim 23, wherein said suction valve member and said discharge valve member are made of a polymeric material.

25. The compressor of claim 23 including a plurality of suction gas apertures spaced about the circumference of said cylinder.

26. The compressor as claimed in claim 25 wherein said plurality of suction gas apertures comprises four apertures spaced ninety degrees apart about the circumference of said cylinder.

27. The compressor of claim 23 including a plurality of suction gas entrances spaced about the circumference of said piston.

28. The compressor as claimed in claim 27 wherein said plurality of suction gas entrances comprises four entrances spaced ninety degrees apart about the circumference of said piston.

29. The compressor of claim 23, wherein said suction valve member and said suction valve seat are substantially semi-toroidal in shape.

30. The compressor of claim 23, wherein said discharge valve member and said discharge valve seat are substantially semi-spherical in shape.

31. A reciprocating hermetic refrigerant compressor, comprising:

a housing;

a motor disposed in said housing and having a stator and a rotor connected to a crankshaft;

a cylinder block disposed in said housing and having an outer wall;

a cylinder head attached to said cylinder block;

a cylinder disposed within said cylinder block and having an outer surface and an inner surface, said inner surface adapted to receive a reciprocating piston, said cylinder block outer wall surrounding said cylinder with said cylinder outer surface being adjacent to and at least partially separated from said cylinder block outer wall so as to form a space therebetween;

a suction gas aperture extending through said cylinder;

a suction gas plenum at least partially formed between said cylinder outer surface, said cylinder block outer wall, and said cylinder head, said suction gas plenum at least partially surrounding said cylinder, said suction gas aperture being in fluid communication with said suction gas plenum and a volume within said cylinder; and a suction gas inlet in fluid communication with said suction gas plenum and said suction gas aperture, whereby suction gas is drawn directly into said cylinder through said suction gas aperture from said suction gas plenum during a suction stroke of said compressor.

32. The compressor as claimed in claim 31, wherein said cylinder head includes a discharge gas chamber formed therein and a valve plate intermediate said cylinder block and said discharge chamber.

33. The compressor as claimed in claim 31 and further comprising:

a suction valve having a suction valve seat formed on an upper surface of said piston and a suction valve member attached to said piston adjacent said suction valve seat;

a suction gas entrance formed in said piston;

a suction gas passage formed in said piston and in fluid communication with said suction gas plenum and said suction valve; and a compression chamber formed in said cylinder between said piston and said cylinder head, whereby during the suction stroke of said compressor suction gas flows from said suction gas inlet into said suction gas plenum, through said suction gas aperture into said cylinder, through said suction gas entrance into said suction gas passage, and through said suction gas valve into said compression chamber.

34. The compressor as claimed in claim 33, wherein said suction valve member is made of a polymeric material.

35. The compressor as claimed in claim 31 further comprising:

a valve plate interposed between said cylinder head and said cylinder block;

a discharge valve interposed between said valve plate and said cylinder head and having a discharge valve member and a discharge valve seat, said piston, said cylinder, said discharge valve, and said valve plate defining said compression chamber.

36. The compressor as claimed in claim 35, wherein said discharge valve member is made of a polymeric material.

37. The compressor as claimed in claim 31 wherein at least one of said cylinder block outer wall and said cylinder outer surface have at least one baffle wall extending therefrom into said suction gas plenum to reduce suction gas pulsations and noise.

38. The compressor as claimed in claim 31 wherein at least one of said cylinder block outer wall and said cylinder outer surface have at least one wall extending therefrom into said suction gas plenum so as to form at least two suction gas sub-plenums.

39. The compressor as claimed in claim 31 and further comprising a suction gas coupling through which suction gas is received into said compressor, said suction gas coupling being connected directly to said suction gas inlet, whereby suction gas is delivered to said cylinder without the use of external suction gas conduits.

40. The compressor as claimed in claim 31 and further comprising a suction gas coupling through which suction gas is received into said compressor and a suction muffler interposed between said suction gas coupling and said cylinder block, said suction gas muffler in fluid communication with said suction gas inlet, whereby suction gas is delivered to said cylinder without the use of external suction gas conduits.

* * * * *